US007878427B2

(12) United States Patent
Wengert

(10) Patent No.: US 7,878,427 B2
(45) Date of Patent: Feb. 1, 2011

(54) INJECTOR FOR FUEL INJECTION IN AN INTERNAL COMBUSTION ENGINE

(75) Inventor: Andreas Wengert, Auenwald (DE)

(73) Assignee: Robert Bosch GmbH, Stuttgart (DE)

( * ) Notice: Subject to any disclaimer, the term of this patent is extended or adjusted under 35 U.S.C. 154(b) by 571 days.

(21) Appl. No.: 11/576,180

(22) PCT Filed: Jul. 18, 2005

(86) PCT No.: PCT/EP2005/053430

§ 371 (c)(1),
(2), (4) Date: Mar. 28, 2007

(87) PCT Pub. No.: WO2006/034890

PCT Pub. Date: Apr. 6, 2006

(65) Prior Publication Data

US 2008/0093481 A1 Apr. 24, 2008

(30) Foreign Application Priority Data

Sep. 28, 2004 (DE) ..... 10 2004 046 888

(51) Int. Cl.
*F02M 63/00* (2006.01)

(52) U.S. Cl. ..... 239/533.2; 239/533.3; 239/575; 239/590

(58) Field of Classification Search ..... 239/533.2, 239/533.3, 533.9, 88, 96, 569, 590, 575; 123/468, 469, 470, 298, 299, 472
See application file for complete search history.

(56) References Cited

U.S. PATENT DOCUMENTS 2,897,800 A * 8/1959 Haas ..... 123/470
4,111,370 A * 9/1978 Chelgren ..... 239/533.3
4,266,728 A * 5/1981 Voss et al. ..... 239/533.8
5,244,152 A * 9/1993 Hofmann ..... 239/533.4
5,617,828 A * 4/1997 Kuegel et al. ..... 123/468

(Continued)

FOREIGN PATENT DOCUMENTS

DE 31 22 883 A1 1/1983

(Continued)

*Primary Examiner*—Dinh Q Nguyen
*Assistant Examiner*—Trevor E McGraw
(74) *Attorney, Agent, or Firm*—Ronald E. Greigg

(57) ABSTRACT

An injector having an injector body to which a fuel line is connected for delivering fuel at high pressure. A filter bore is formed in the body and a fuel filter is disposed, through which filter the delivered fuel flows. A sealing seat is formed in the filter bore against which seat the end of the fuel line is pressed upon fastening of the fuel line to the injector body. The filter bore discharges at the outside of the injector body. The sealing seat is disposed with its longitudinal axis inclined to the longitudinal axis of the filter bore, and in the injector body, a bore extending at least approximately coaxially to the sealing seat is provided, into which the end region of the fuel line plunges. By the end region, plunging into the bore, of the fuel line, an outer end region of the filter bore, discharging at the outside of the injector body, is separated from an inner end region, subjected to high pressure, of the filter bore, and the fuel filter is disposed in the inner end region of the filter bore.

6 Claims, 3 Drawing Sheets

U.S. PATENT DOCUMENTS

| | | | | |
|---|---|---|---|---|
| 5,743,470 | A * | 4/1998 | Schlaf et al. | 239/533.4 |
| 5,803,369 | A * | 9/1998 | Toyao et al. | 239/533.8 |
| 5,996,908 | A * | 12/1999 | Hofmann et al. | 239/533.3 |
| 6,234,404 | B1 * | 5/2001 | Cooke | 239/88 |
| 6,334,432 | B1 * | 1/2002 | Ferraro et al. | 123/468 |
| 6,719,224 | B2 * | 4/2004 | Enomoto et al. | 239/585.1 |
| 6,729,554 | B2 * | 5/2004 | Katsura et al. | 239/88 |
| 2003/0071145 | A1 * | 4/2003 | Kulovits et al. | 239/533.2 |
| 2003/0111558 | A1 * | 6/2003 | Ricco | 239/533.2 |
| 2004/0026540 | A1 * | 2/2004 | Haeberer et al. | 239/585.1 |
| 2004/0089268 | A1 | 5/2004 | Brenk et al. | |
| 2005/0103882 | A1 * | 5/2005 | Cobianchi et al. | 239/96 |

FOREIGN PATENT DOCUMENTS

| | | | |
|---|---|---|---|
| DE | 100 57 683 | A1 | 6/2002 |
| EP | 0 999 363 | A1 | 5/2002 |

* cited by examiner

INJECTOR FOR FUEL INJECTION IN AN INTERNAL COMBUSTION ENGINE

CROSS-REFERENCE TO RELATED APPLICATION

This application is a 35 USC 371 application of PCT/EP 2005/053430 filed on Jul. 18, 2005.

BACKGROUND OF THE INVENTION

1. Field of the Invention

The invention is based on an injector for fuel injection in an internal combustion engine.

2. Description of the Prior Art

One injector is known from German Patent Disclosure DE 100 57 683 A, has an injector body, to which a fuel line is connected by which fuel at high pressure is delivered from a reservoir to the injector. In the injector body, a bore is provided, into which a fuel filter is inserted, through which filter the fuel delivered through the fuel line flows upstream of the injection. In the filter bore, a sealing seat is formed against which the end region of the fuel line is pressed upon the securing of the fuel line to the injector body. The sealing seat and the end region of the fuel line are disposed with their longitudinal axes at least approximately coaxially to the filter bore. The location of the filter bore in the injector body must be selected in accordance with the space available in the injector body, whereupon the location of the end region of the fuel line is then also defined and cannot be selected optimally to suit the space conditions in the surroundings of the injector. The result under some circumstances can be an unfavorable installed position of the end region of the fuel line, and especially in the longitudinal direction of the injector a great structural height can ensue, which can make it more difficult to install an engine equipped with the injector in a motor vehicle. In particular, the attempt is made to keep the structural height of the engine low, to create enough deformation distance above the engine for the motor vehicle hood, which future regulations will require for pedestrian protection.

SUMMARY AND ADVANTAGES OF THE INVENTION

The injector of the invention has the advantage over the prior art that the location where the fuel line is connected can be selected independently of the location of the filter bore in the injector body. The fuel filter can be inserted in a simple way into the filter bore, since the filter bore discharges at the outside of the injector body, and the sealing seat, which is inclined relative to the longitudinal axis of the filter bore, can be machined in a simple way through the filter bore. The sealing seat and the end region of the fuel line can be arbitrarily inclined to the longitudinal axis of the filter bore, so that they can be optimally adapted to the existing space available.

Advantageous features and refinements of the injector of the invention are disclosed. One embodiment makes especially simple securing of the fuel line to the injector body possible, the only additional component required being a hollow screw.

BRIEF DESCRIPTION OF THE DRAWINGS

Two exemplary embodiments of the invention are described in further detail herein below, with reference to the drawings, in which.

DESCRIPTION OF THE PREFERRED EMBODIMENTS

Figure 1:
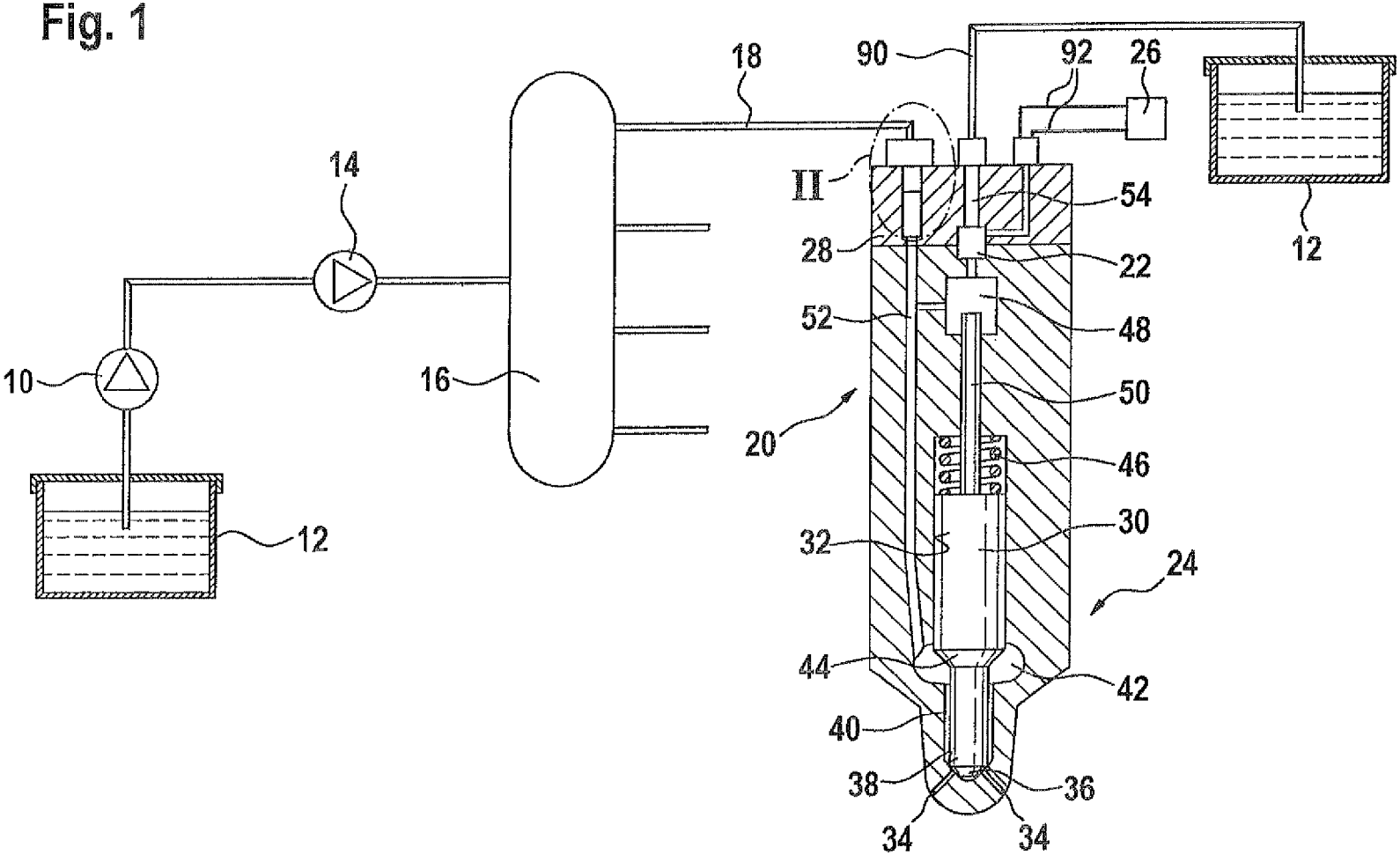
FIG. 1 shows a fuel injection system for an internal combustion engine in a schematic illustration.

In FIG. 1, a fuel injection system for an internal combustion engine of a motor vehicle is shown. The engine is preferably a self-igniting engine and has a plurality of cylinders. The fuel injection system has a feed pump 10, by which fuel is pumped from a tank 12 to a high-pressure pump 14. By means of the high-pressure pump 14, fuel is pumped at high pressure into a high-pressure reservoir 16. Via high-pressure lines 18, injectors 20 located at the cylinders of the engine communicate with the high-pressure reservoir 16. Each injector 20 has a control valve 22, by means of which a fuel injection valve 24, also forming part of the injector 20, can be opened for a fuel injection or closed to terminate a fuel injection. The control valves 22 of the injectors 20 communicate with an electronic control unit 26 and are triggered by it as a function of engine operating parameters.

The injector 20 has a multiple-part injector body 28, in which the fuel injection valve 24 is disposed, in its end region oriented toward the combustion chamber of the cylinder. The fuel injection valve 24 has at least one injection valve member 30, which is guided displaceably in a bore 32. At least one and preferably a plurality of injection openings 34, distributed over the circumference of the injector 20, on the end of the injector body 28 protruding into the combustion chamber are controlled by the injection valve member 30. The injection valve member 30, in its end region toward the combustion chamber, has a sealing face 36, which is approximately conical for example, and which cooperates with an approximately conical valve seat 38, embodied in the injector body 28 in its end region toward the combustion chamber, from which or downstream of which valve seat the injection openings 34 lead away. In the injector body 28, between the injection valve member 30 and the bore 32, toward the valve seat 38, there is an annular chamber 40, which in its end region remote from the valve seat 38 changes over, as a result of a radial widening of the bore 32, into a pressure chamber 42 surrounding the injection valve member 30. At the level of the pressure chamber 42, as a result of a cross-sectional reduction towards its sealing face 36, the injection valve member 30 has a pressure shoulder 44. The end of the injection valve member 30 remote from the combustion chamber is engaged by a prestressed closing spring 46, by which the injection valve member 30 is pressed with its sealing face 36 toward the valve seat 38.

In the injector body 28, a control chamber 48 is also formed, which is defined by the injection valve member 30 or by a control piston 50 connected to it, and as a result of the pressure prevailing in the control chamber 48, a force on the injection valve member 30 in the closing direction is generated. The high-pressure line 18 is connected to the injector body 28, and inside the injector body 28, an inlet bore 52 leads to the pressure chamber 42. The control chamber 48 likewise communicates with the inlet bore 52 and furthermore has a connection 54, controlled by the control valve 22, with a relief region, which is for instance a return to the tank 12. If the connection 54 of the control chamber 48 with the relief region is closed by the control valve 22, then high pressure prevails in the control chamber 48 as in the pressure chamber 42, so that the injection valve member 30 remains in its closing position, and no fuel injection takes place. When the control valve 22 is opened, so that the connection 54 of the control chamber 48 with the relief region is opened, then the control chamber 48 is relieved, and the injection valve member 30 opens as a consequence of the high pressure operative in the pressure chamber 42 on its pressure shoulder 44, so that fuel is injected. The control valve 22 may have an electromagnetic actuator or a piezoelectric actuator.

Figure 2:
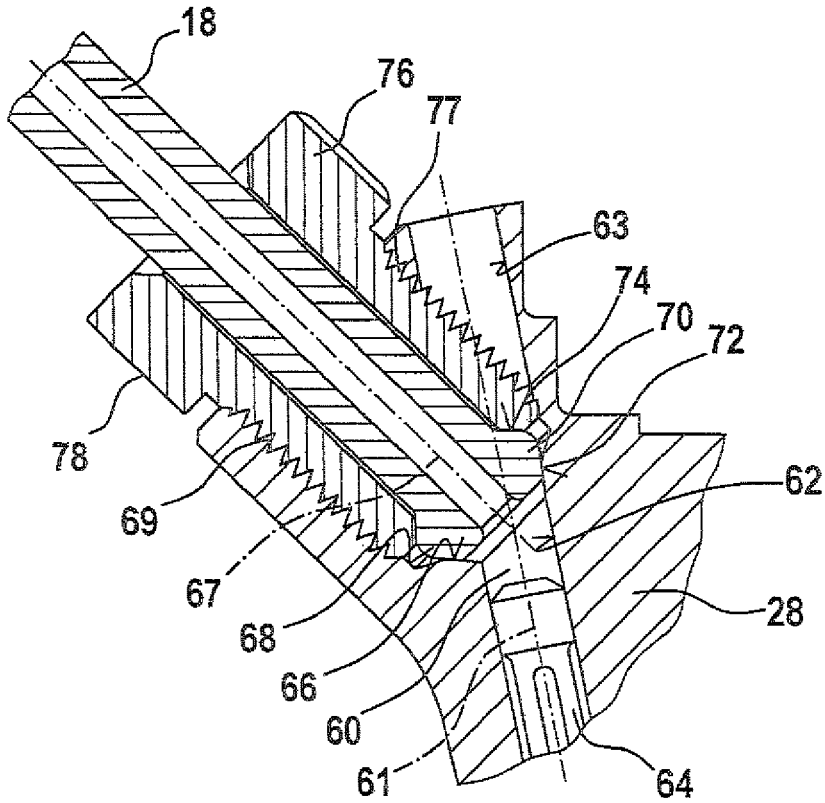
FIG. 2, in an enlarged view, shows a detail marked II of FIG. 1 of an injector of the fuel injection system in a first exemplary embodiment.

In FIG. 2, the injector 20 is shown in fragmentary form, enlarged, in a first exemplary embodiment; the connection of the fuel line 18 is especially apparent. In a part of the injector body 28 remote from the combustion chamber of the cylinder, a bore 60 is provided, which discharges at the outside of the injector body 28. The bore 60 may extend with its longitudinal axis 61 approximately parallel, for instance, to the longitudinal axis of the injection valve member 30 or slightly inclined to the longitudinal axis of the injection valve member 30, as is shown in FIG. 2. A fuel filter 64, for instance of barlike shape, is inserted into the bore 60, and the bore 60 will therefore hereinafter be called the filter bore. The filter bore 60 communicates with the inlet bore 52 that leads to the pressure chamber 42 and the control chamber 48. In the filter bore 60, a sealing seat 66 is provided, which is formed at a cross-sectional reduction of the filter bore 60; the filter bore 60 has an inner bore portion 62 of small diameter, in which the fuel filter 64 is located, and an outer bore portion 63 of larger diameter, which discharges at the outside of the injector body 28. The two bore portions 62 and 63 may also have the same diameter. The sealing seat 66 is embodied for instance as at least approximately frustoconical, and its longitudinal axis 67 extends in inclined fashion relative to the longitudinal axis 61 of the filter bore 60.

A further bore 68 is provided in the part of the injector body 28, discharging at its outside; this further bore extends at least approximately coaxially to the sealing seat 66, and the end region of the fuel line 18 plunges into it. The bore 68 is provided with a female thread 69. A thickened portion 70 is provided on the end region of the fuel line 18, on the outer jacket of which portion a sealing face 72 that comes into contact with the sealing seat 66 is disposed; this sealing face, like the sealing seat 66, may be embodied as at least approximately frustoconical, or for instance it may be embodied as at least approximately spherical. On the side of the thickened portion 70 of the fuel line 18 remote from the sealing face 72, an annular shoulder 74 is embodied. A hollow screw 76 is disposed on the end region of the fuel line 18, and its inside diameter is smaller than the outer diameter of the thickened portion 70 of the fuel line 18. The hollow screw 76 is screwed with its male thread 77 into the female thread 69 of the bore 68 of the injector body 28. With its face end, the hollow screw 76 comes into contact in the axial direction with the annular shoulder 74 of the thickened portion 70 of the fuel line 18, as a result of which the thickened portion 70 is pressed with its sealing face 72 against the sealing seat 66. On its end protruding from the bore 68, the hollow screw 76 is provided for instance with a hexagonal profile 78 or a polygonal profile, which a tool can engage in order to secure the hollow screw 76.

The end region of the fuel line 18 that plunges into the bore 68 separates the outer bore portion 63 of the filter bore 60 from the inner bore portion 62; only the inner bore portion 62, in which the fuel filter 64 is disposed, is subjected to high pressure, and its sealing is effected by the fuel line 18 that is pressed against the sealing seat 66. The location of the further bore 68 and of the sealing seat 66 can be selected to suit the space available, independently of the location of the filter bore 60.

Figure 3:
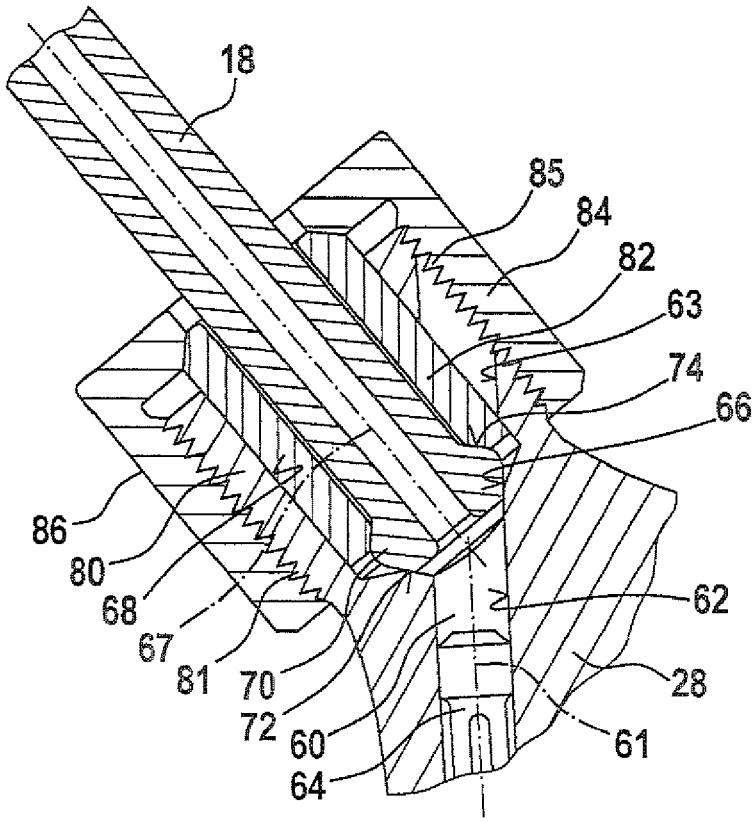
FIG. 3 shows the detail II of the injector in a second exemplary embodiment.

In FIG. 3, the injector 20 is shown in fragmentary form in a second exemplary embodiment, in which the basic construction is the same as in the first exemplary embodiment. The further bore 68, into which the end region of the fuel line 18 plunges, is embodied in a stub 80, which protrudes from the injector body 28 and which is provided with a male thread 81. The filter bore 60 penetrates the stub 80 of the injector body 28. The thickened portion 70 is disposed on the end of the fuel line 18; it has the sealing face 72, oriented toward the sealing seat 66, and the annular shoulder 74 facing away from the sealing face. On the end region of the fuel line 18, there is a sleeve 82, whose inside diameter is less than the outside diameter of the thickened portion 70, so that the sleeve 82 with its face end comes into contact in the axial direction with the annular shoulder 74 of the thickened portion 70. The sleeve 82 plunges together with the end region of the fuel line 18 into the bore 68. On the end region of the fuel line 18, there is also a union nut 84, surrounding the sleeve 82, which has a smaller inside diameter on one end than the outer diameter of the sleeve 82, so that the union nut 84 comes into contact with the sleeve 82 in the axial direction. The union nut 84 is screwed with its female thread 85 onto the male thread 81 of the stub 80 of the injector body 28, and on its outer jacket it has a hexagonal profile 86, for instance, which can be engaged by a tool. In the second exemplary embodiment as well, the end region of the fuel line 18 that plunges into the bore 68 divides the outer bore portion 63 of the filter bore 60 from the inner bore portion 62; only the inner bore portion 62, in which the fuel filter 64 is disposed, is subjected to high pressure, and its sealing is effected by the fuel line 18 pressed against the sealing seat 66.

Figure 4:
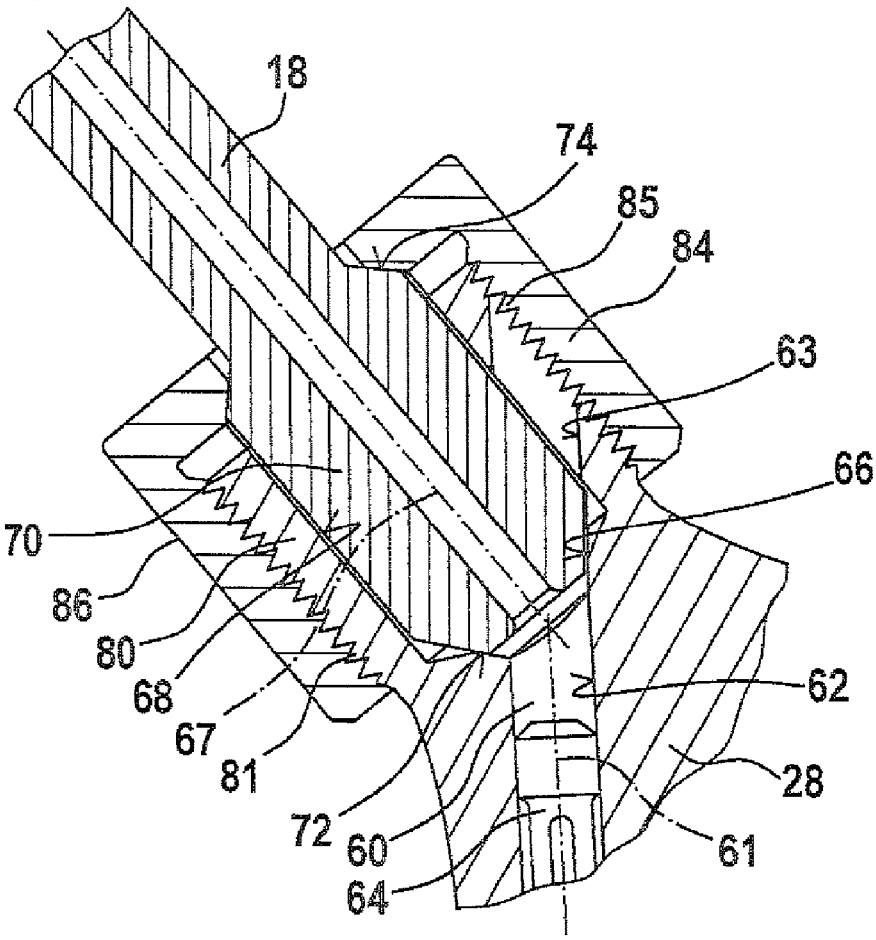
FIG. 4 shows the detail II of the injector in a version that is modified compared to FIG. 3.

In FIG. 4, the injector 20 is shown in fragmentary form in a version modified slightly compared to FIG. 3; the thickened portion 70 on the end region of the fuel line 18 has a substantially greater length in the direction of the longitudinal axis of the fuel line 18. Here the thickened portion 70 extends as far as the end of the stub 80, so that the union nut 84 can directly engage the annular shoulder 74 of the thickened portion 70, and the sleeve 82 of the version according to FIG. 3 can be omitted.

In addition to the fuel line 18 that carries high pressure, a relief fuel line 90 can also be connected to the injector body 28, through which relief line, when the control valve 22 is open, fuel withdrawn from the control chamber 48 can be diverted at least indirectly into the tank 12. Electrical lines 92 for the electrical contacting of the electrical actuator of the control valve 22 are also connected to the injector body 28.

The foregoing relates to a preferred exemplary embodiment of the invention, it being understood that other variants and embodiments thereof are possible within the spirit and scope of the invention, the latter being defined by the appended claims.

The invention claimed is:

1. An injector for fuel injection in an internal combustion engine, the injector having an injector body, a fuel line connected to the injector body, the fuel line having an end, and through which fuel line fuel at high pressure is delivered, a filter bore in the injector body, the filter bore having a longitudinal axis and a fuel filter disposed in the filter bore through which the delivered fuel flows, and a sealing seat formed in the filter bore against which the end of the fuel line is pressed upon fastening of the fuel line to the injector body, the improvement wherein the filter bore extends to the outside edge of the injector body; wherein the sealing seat has a longitudinal axis and is disposed with its longitudinal axis inclined to the longitudinal axis of the filter bore; wherein a further bore is formed in the injector body, which further bore extends at least approximately coaxially with the longitudinal axis of the sealing seat and into which the end of the fuel line plunges; wherein, the end of the fuel line plunges into the further bore and engages against the sealing seat, thus dividing the filter bore into an outer end region which extends to the outside edge of the injector body, and an inner end region of the filter bore; and wherein the fuel filter is disposed in the inner end region of the filter bore.

2. The injector as defined by claim 1, wherein the further bore in the injector body has a female thread; and wherein the end of the fuel line includes a thickened portion, and a hollow screw is disposed on the end of the fuel line and is screwed with a male thread into the female thread of the bore, whereby when the hollow screw is screwed into the female thread of the further bore, the hollow screw presses the thickened portion against the sealing seat.

3. The injector as defined by claim 1, wherein the further bore in the injector body extends in a stub protruding from the injector body, which stub is provided with a male thread; and wherein a union nut disposed on the end region of the fuel line, which union nut is screwed with its female thread onto the male thread of the stub and by which, at least indirectly, the end of the fuel line is pressed against the sealing seat.

4. The injector as defined by claim 3, wherein the filter bore penetrates the stub of the injector body.

5. An injector for fuel injection in an internal combustion engine, the injector having an injector body, a fuel line connected to the injector body, the fuel line having an end region, and through which fuel line fuel at high pressure is delivered, a filter bore in the injector body, a fuel filter disposed in the filter bore through which the delivered fuel flows, and a sealing seat formed in the filter bore against which the end region of the fuel line is pressed upon fastening of the fuel line to the injector body, the improvement wherein the filter bore extends to the outside edge of the injector body; wherein the sealing seat is disposed with its longitudinal axis inclined to the longitudinal axis of the filter bore; wherein a further bore formed in the injector body extends at least approximately coaxially to the sealing seat and into which the end region of the fuel line plunges; wherein by the end region of the fuel line plunging into the further bore of the fuel line, an outer end region of the filter bore, which extends to the outside edge of the injector body, is separated from an inner end region of the filter bore, wherein the inner end region of the filter bore is subjected to high pressure, and wherein the fuel filter is disposed in the inner end region of the filter bore, wherein the further bore in the injector body extends in a stub protruding from the injector body, which stub is provided with a male thread; and wherein a union nut disposed on the end region of the fuel line, which union nut is screwed with its female thread onto the male thread of the stub and by which, at least indirectly, the end of the fuel line is pressed against the sealing seat, wherein a sleeve is disposed on the end region of the fuel line inside the union nut, the sleeve plunging into the further bore and against which sleeve the union nut comes into contact in the axial direction and by which sleeve the end of the fuel line is pressed against the sealing seat.

6. The injector as defined by claim 5, wherein the filter bore penetrates the stub of the injector body.

* * * * *